United States Patent [19]

Narasimhan et al.

[11] Patent Number: 4,588,439

[45] Date of Patent: May 13, 1986

[54] OXYGEN CONTAINING PERMANENT MAGNET ALLOY

[75] Inventors: Kalathur S. V. L. Narasimhan, Monroeville; Carol J. Willman, Bethel Park; Edward J. Dulis, Upper St. Clair, all of Pa.

[73] Assignee: Crucible Materials Corporation, Pittsburgh, Pa.

[21] Appl. No.: 736,017

[22] Filed: May 20, 1985

[51] Int. Cl.[4] ..... C22C 33/00

[52] U.S. Cl. ..... 75/123 B; 75/123 E; 148/31.57

[58] Field of Search ..... 148/31.57; 75/123 R, 75/123 E

[56] References Cited

FOREIGN PATENT DOCUMENTS 0101552 2/1984 European Pat. Off. .
0108474 5/1984 European Pat. Off. ..... 148/31.55
0106948 5/1984 European Pat. Off. .
0126179 11/1984 European Pat. Off. .

*Primary Examiner*—John P. Sheehan
*Attorney, Agent, or Firm*—Finnegan, Henderson, Farabow, Garrett & Dunner

[57] ABSTRACT

A permanent magnet alloy that when used in the production of a permanent magnet results in a magnet that is highly resistant to disintegration when exposed to a combination of humidity and heat. Consequently, the alloy consists essentially of, in weight percent, 30 to 36 of at least one rare earth element, 60 to 66 iron, 6,000 to 35,000 ppm oxygen and balance boron.

6 Claims, 1 Drawing Figure

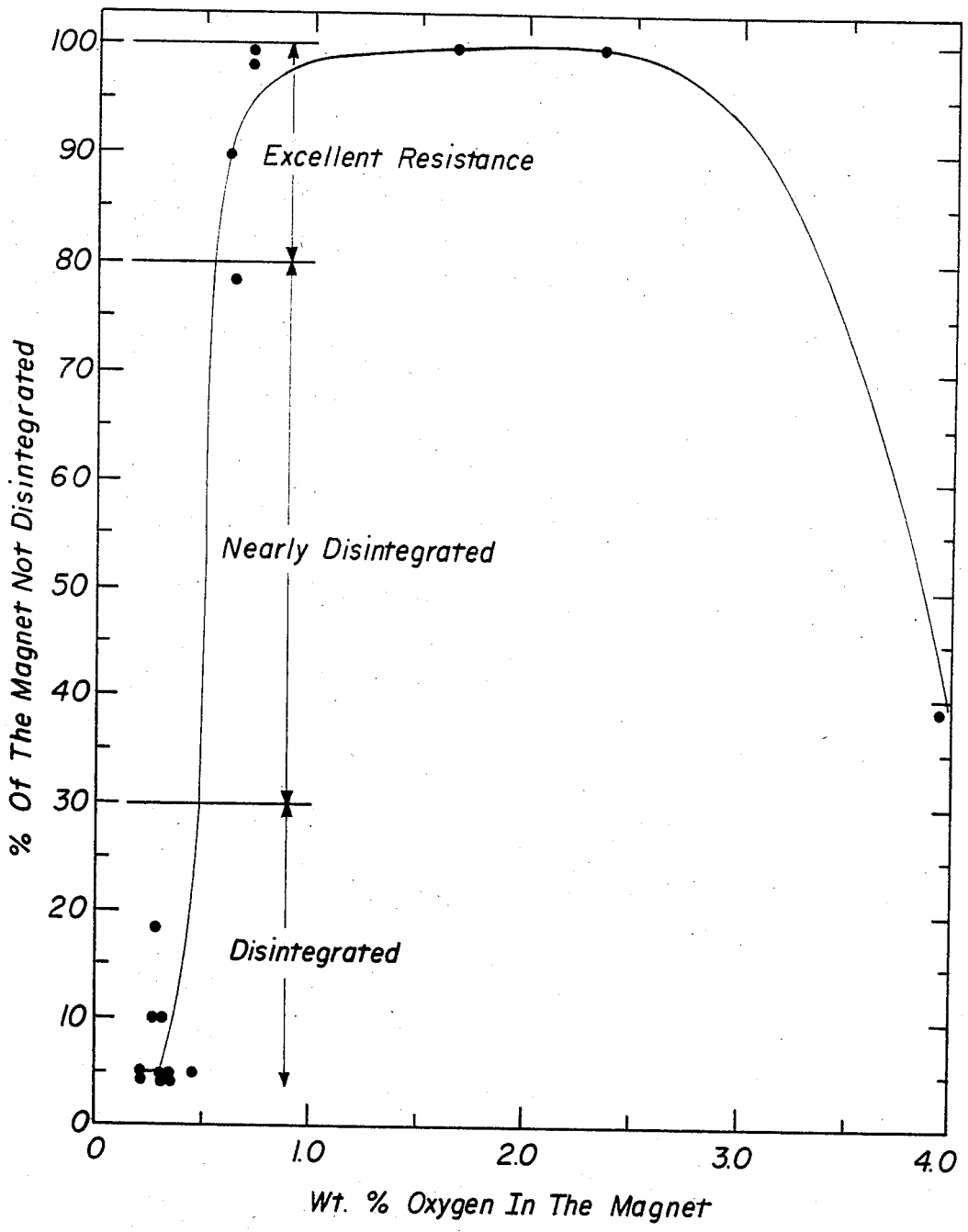
100
90
80
70
60
50
40
30
20
10
0
% Of The Magnet Not Disintegrated
Excellent Resistance
Nearly Disintegrated
Disintegrated
0
1.0
2.0
3.0
4.0
Wt. % Oxygen In The Magnet

OXYGEN CONTAINING PERMANENT MAGNET ALLOY

Permanent magnets productd from alloys containing iron in combination with at least one rare earth element and boron provide magnets having maximum energy product, which may be on the order of 45 MGOe. Energy product, as is well known, is a measure of the usefulness of a magnet and therefore magnets of these alloys are of significant commercial value. It has been found, however, that these iron-containing magnets do not exhibit physical stability under heat and humidity. In most commercial applications heat and humidity are present. Under these conditions iron-containing permanent magnets react with the hydrogen present in the humid atmosphere and the hydrogen absorbed by the alloys of the magnet result in the disintegration of the magnet. Specifically, the reaction is initiated on the surface of the magnet with the surface thereof providing active sites for the catalytic decomposition of water and resultant absorption of hydrogen.

It is accordingly a primary object of the present invention to provide a magnet alloy that may be used for the production of permanent magnets that will result hydrogen absorption and decomposition when used in applications of humidity and heat.

This and other objects of the invention as well as a more complete understanding thereof may be obtained from the following description and specific examples:

The single FIGURE of the drawing is a curve relating weight percent oxygen in a magnet in the percent of the magnet not disintegrated.

Broadly, in the practice of the invention, magnet alloy consisting of, in weight percent, 30 to 36 of at least one rare earth element, 60 to 66 iron, and balance iron has added thereto oxygen within the range of 6,000 to 35,000 ppm, preferably 9,000 to 30,000 ppm. The rare earth element content may include at least one rare earth element neodymium and dysprosium.

Although the oxygen may be added to the alloy in any effective manner it has been found that by jet milling in an oxygen containing atmosphere the oxygen content of the alloy in powder form may be effectively produced within the limits necessary for the invention.

EXAMPLE 1

An alloy of composition in weight percent 33 neodynmium, 66 iron, 1 boron was melted, crushed and milled to a particle size of 5 microns. The powder was oriented in a magnetic field and sintered at 1050°-1100° C. to form magnets and cooled to room temperature. The magnetic properties of these magnets were as follows:

TABLE I

| $B_r$ (G) | $H_c$ (Oe) | $H_{ci}$ (Oe) | $H_k$ (Oe) | $BH_{max}$ (MGOe) |
|---|---|---|---|---|
| 12,600 | 8,800 | 10,600 | 6,900 | 35.8 |
| 12,900 | 9,500 | 10,600 | 8,500 | 38.4 |
| 12,600 | 9,300 | 11,200 | 7,700 | 37.4 |

The analyzed composition on the magnet had an oxygen content of 2,000 ppm as an integral part of the alloy.

These magnets were exposed to a high temperature and humidity utilizing an autoclave. The steam temperature was maintained at 315° F. for 16 hours. This test provides a means of accelerated testing of long term stability. After this test, the magnets were totally disintegrated.

EXAMPLE 2

To verify whether the rare earth content has any controlling effect on the disintegration of the magnets, a series of alloys were prepared with varying rare earth content and processed by similar procedures described above into magnets. The magnetic properties of the magnets are shown in Table II.

TABLE II

| Specimen No. | Total Rare Earth (Dy + Nd) (Wt %) | Fe (Wt %) | B (Wt %) | $B_r$ (G) | $H_c$ (Oe) | $H_{ci}$ (Oe) | $BH_{max}$ (MGOe) |
|---|---|---|---|---|---|---|---|
| C-1 | 36.44 | 62.71 | 0.85 | 9,200 | 8,650 | 23,800 | 20.70 |
| C-2 | 39.19 | 60.06 | 0.75 | 8,000 | 7,500 | 25,000 | 14.80 |
| C-3 | 41.93 | 57.42 | 0.65 | 7,000 | 6,400 | 32,600 | 10.9 |
| C-4 | 34.17 | 64.89 | 0.94 | 11,100 | 8,100 | 10,000 | 27.0 |
| C-5 | 33.50 | 65.54 | 0.964 | 10,400 | 9,650 | 20,600 | 25.0 |
| C-6 | 32.14 | 66.89 | 0.971 | 10,200 | 7,000 | 8,450 | 23.3 |
| C-7 | 30.77 | 68.25 | 0.978 | 11,200 | 3,900 | 4,600 | 21.2 |
| C-8 | 29.41 | 69.60 | 0.986 | 12,000 | 6,500 | 6,900 | 32.3 |
| C-9 | 28.04 | 70.97 | 0.993 | 12,400 | 4,400 | 4,550 | 28.0 |
| C-10 | 26.68 | 72.32 | 1.00 | 13,000 | 3,800 | 4,000 | 27.9 |

The oxygen content of these magnets before the autoclave test was 2,000 parts per million.

EXAMPLE 3

Having determined that the variation of rare earth content does not improve the stability of these magnets, a controlled amount of oxygen was added during processing to increase the oxygen content to 8,000 ppm from the previously used 2,000 ppm of oxygen for the specimens reported in Table II. Magnets were made and subjected to the autoclave test. The properties of these magnets before and after the autoclave test are shown in Table III.

TABLE III

MAGNETIC PROPERTIES ON AUTOCLAVE TESTED MAGNETS (Before refers to the properties on the magnets before the test was made)

| Condition | $B_r$ (G) | $H_{ci}$ (Oe) | $H_c$ (Oe) | $H_k$ (Oe) | $BH_{max}$ (MGOe) |
|---|---|---|---|---|---|
| Before | 11,200 | 20,000 | 10,900 | 17,900 | 30.6 |
| After | 11,300 | 19,500 | 10,900 | 15,900 | 31.4 |
| Before | 10,900 | 19,200 | 10,500 | 15,900 | 28.9 |
| After | 10,800 | 18,900 | 10,500 | 14,800 | 28.1 |
| Before | 11,200 | 20,200 | 10,900 | 18,000 | 30.5 |
| After | 11,100 | 20,000 | 10,700 | 16,000 | 29.4 |
| Before | 11,000 | 18,700 | 10,600 | 15,100 | 28.9 |
| After | 11,100 | 18,400 | 10,700 | 15,100 | 29.3 |

From this test it is clear that increasing the oxygen content improves the stability of the magnets under high-temperature, humid conditions.

EXAMPLE 4

In order to ascertain the lower and upper limits of oxygen, a series of magnets were prepared from the composition and processing conditions set forth in Example 1 with varying oxygen content. These magnets were then exposed to temperature and humidity in the autoclave test. The results of this experiment are shown graphically in the FIGURE. The grading for the magnets was given by visually inspecting these magnets. The proportion of the solid magnet remaining compared to the powder produced by the disintegration process was used as a measure of classifying into fully disintegrated (0–20% solid), partially disintegrated (20–80% solid), and excellent resistance (80–100% solid).

We claim:

1. A permanent magnet alloy consisting essentially of, in weight percent, 30 to 36 of at least one rare earth element, 60 to 66 iron, 6,000 to 35,000 ppm oxygen and balance boron.

2. The alloy of claim 1 wherein at least one of said rare earth elements is neodymium.

3. The magnet alloy of claim 2 wherein at least one of said rare earth elements is dysprosium.

4. A permanent magnet alloy consisting essentially of, in weight percent, 30 to 36 of at least one rare earth element, 60 to 66 iron, 9,000 to 30,000 ppm oxygen, and balance boron.

5. The alloy of claim 4 wherein at least one of said rare earth elements is neodymium.

6. The magnet alloy of claim 4 wherein at least one of said rare earth elements is dysprosium.

* * * * *